United States Patent [19]

Kunikane

[11] Patent Number: 4,914,416

[45] Date of Patent: Apr. 3, 1990

[54] PRESSURE SENSING ELECTRIC CONDUCTOR AND ITS MANUFACTURING METHOD

[76] Inventor: Takahiro Kunikane, 2335 Komuro, Inamachi, Saitama-ken, Japan

[21] Appl. No.: 230,590

[22] Filed: Aug. 10, 1988

[51] Int. Cl.[4] ..... H01C 10/10

[52] U.S. Cl. ..... 338/114; 338/99; 29/610.1

[58] Field of Search ..... 338/114, 99, 295; 29/610.1; 340/365 A

[56] References Cited

U.S. PATENT DOCUMENTS 4,357,266 11/1982 Sado et al. ..... 338/114 X 4,529,959 7/1985 Ito et al. ..... 338/114 X

*Primary Examiner*—Teresa J. Walberg

*Assistant Examiner*—Marvin M. Lateef

*Attorney, Agent, or Firm*—Thomas R. Morrison

[57] ABSTRACT

A pressure-sensing electric conductor, has an elastic electric conductive layer made of silicone rubber, on which a flexible insulating layer made of resin having a number of holes in a form of net pattern is overlaid. The pressure-sensing electric conductor is produced by applying a silicone adhesive compound to which toluene and silicone ink are added over the flexible sheet of resin insulating layer having a number of holes, and adhering said sheet to said electric conductor formed by means of vulcanization into an elastic sheet, and by bonding them together by applying pressure to both sides of the resin insulator and electric conductor.

16 Claims, 5 Drawing Sheets

PRESSURE SENSING ELECTRIC CONDUCTOR AND ITS MANUFACTURING METHOD

BACKGROUND OF THE INVENTION

1. Technical Field of the Invention

This invention relates to a pressure-sensing electric conductor used in a graphic input device and/or switching device of a computer system, and to the manufacturing method thereof.

2. Description of the Prior Art

A pressure-sensing electric conductor which becomes conductive when impressed by exterior force is widely used in prior art. FIG. 9 is a sectional view of an embodiment of the pressure-sensing electric conductor disclosed in Japanese Patent Laid Open Publication No. 897/1978. Said pressure-sensing electric conductor is obtained by filling the rubber 1, an elastic body, with metal particles 2, and then making admixture thereof. When pressure is applied on said conductor from the direction indicated by the arrow in the drawing, the metal particles located in the portion where pressure is applied contact each other to form a link of conductive substance from one end to the other. FIG. 10 is an embodiment of said pressure-sensing electric conductor applied to a tablet or switching device. The rubber 1 filled with metal particles 2 is interposed between a substrate 3 and a flexible protective sheet 4, and the electrodes $E_1$ and $E_2$ in stripes are formed on the inner side of the substrate 3. When pressure is applied in the direction shown by an arrow in the drawing, the impressed spot becomes conductive.

FIG. 11 is an embodiment of the pressure-sensing electric conductor of prior art, disclosed in Japanese Utility Model laid open under No. 41588/1981. Said pressure-sensing electric conductor is obtained by means of printing a pattern using the insulating ink 6 on an elastic electric conductive sheet 5. FIG. 12 shows said pressure-sensing electric conductor being applied to a tablet or a switch. When pressure is not applied on the conductor, the insulating ink 6 separates the electric conductive sheet 5 from the electrodes $E_1 \sim E_4$, and when pressure is impressed over the protective sheet 4, the electric conductive sheet 5 is deformed, and its portion where pressure is applied touches the electrode to become electrically conductive.

In the pressure-sensing electric conductor is generally provided by filling the elastic rubber 1 with metal particles 2 and forming an admixture thereof, or by printing a pattern of the insulating layer using the insulating ink 6 over the flexible electric conductive sheet 5. These pressure-sensing electric conductors may not provide satisfactory characteristics in the sensitivity, durability, and resolution because of the use of metal particles 2 or insulating ink 6.

As an alternative, an insulating layer made of resin and having a number of holes to be laminated over a sheet form of electric conductor is suggested. Said pressure-sensing sensing electric conductor having an insulating layer of resin, such as polyester mesh and the like, is not liable to deterioration over elapsed time, and has improved sensitivity characteristics and durability.

The pressure-sensing electric conductor using metal particles, as shown in FIGS. 9 and 10, generates varying resistance when conducting electricity because of the oxidizing of metal particles 2, giving cause to chattering at a spot where the conductor is applied with pressure because of a number of metal particles contacting each other, and thus causes the sensitivity to deteriorate over the elapsed time, and also results in costlier operation of a device it is applied with.

The pressure-sensing electric conductor, as shown in FIGS. 11 and 12, where a pattern of the insulating layer is printed using the insulating ink 6 over the flexible electric conductive sheet 5, the distances and thickness the insulating patterns formed by using said insulating ink 6 have certain limitations that preclude optional determination of the input sensitivity, and at the same time provide the durability against the repeated impressions limited to a certain extent.

These pressure-sensing electric conductors may not provide satisfactory characteristics in the sensitivity, durability, and resolution because of the use of metal particles 2 or insulating ink 6. The pressure-sensing electric conductors of prior art having the insulating layer of resin are produced by coating adhesive agent on the insulating substance of resin material, simply adhering it over a sheet form of electric conducting substance, and by pressing them together. The resulting conductors fail to attain either sufficient adhesive strength or satisfactory sensitivity characteristics.

SUMMARY OF THE INVENTION

An object of this invention is therefore to provide a pressure-sensing electric conductor having improved sensitivity characteristics, durability, and capability of determining the input sensitivity at the desired level, which is simple in structure and therefore less expensive to produce.

The pressure-sensing electric conductor of this invention is produced by having a flexible insulating layer made of resin and having a number of holes in a pattern of net overlaid on an elastic electric conductive layer made of silicone rubber.

Another object of this invention is to provide a processing method whereby a pressure-sensing electric conductor may be obtained with sufficient adhesive strength between the electric conductive body and the insulating body to obtain the satisfactory sensitivity characteristics.

The pressure-sensing electric conductor of this invention is provided by applying a silicone adhesive agent to which toluene and silicone ink are added on a flexible sheet form made of silicone insulating substance perforated with a number of holes, overlaying said resin insulating sheet on the elastic vulcanized sheet form of electric conductive substance, and then by pressing both the resin insulating and electric conductive sheets together.

DESCRIPTION OF PREFERRED EMBODIMENTS

Figure 1A:
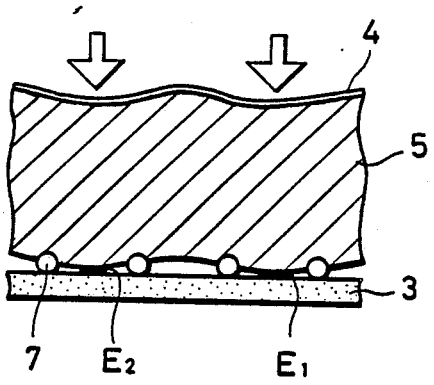
FIGS. 1(*a*) and (*b*) are cross sections indicating the basic structure of the pressure-sensing electric conductor of this invention.
Figure 1B:
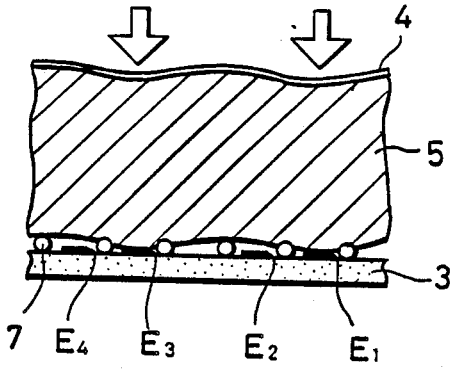

FIG. 1 illustrates the basic structure of the pressure-sensing electric conductor of this invention, made for use on a tablet or switch used for entering coordinate inputs into a computer system. In the drawing, the electric conductive layer comprises an insulating substrate 3, an outer protective sheet 4, and an elastic electrically conductive sheet 5. A flexible insulating layer of resin having a number of holes 7 adjoins said electric conductive sheet 5, and the $E_1 \sim E_4$ are the electrodes disposed to form stripes of electrode layer on the substrate 3, adjoining an insulating layer 7 made of resin.

Said electric conductive sheet 5 is made of silicone rubber, and the resin insulating layer 7 is formed in a net pattern.

The pressure-sensing electric conductor comprising said electrically conductive sheet 5 and the resin insulating layer 7 deforms at the spot where exterior pressure is applied, and contacts the electrode to form electrically conductive state. Since metal particles of prior art are not used, it is neither liable to considerable deterioration over elapsed time nor chattering, and has enhanced sensitivity characteristics. Furthermore, the conductor is less expensive and simple in construction, and electrodes $E_1$ and $E_2$ may be made conductive with each other as shown in FIG. 1(*a*) since it becomes possible to form a conductive state in other directions than the direction to which the pressure is applied. Since the flexible resin insulating layer 7 of stronger durability against applied pressure is used instead of the insulating ink, and because the insulating pattern thereof is selectable at an optional level, the input sensitivity may be set as desired. Consequently, if pressure is applied at the electrodes $E_1$ and $E_3$, as shown in FIG. 1(*b*), only those $E_1$ and $E_3$ become conductive, while the other electrodes remain insulated.

Figure 2:
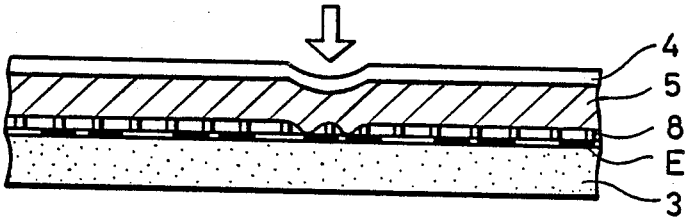
FIG. 2 is a cross section of an embodiment of this invention.

FIG. 2 is a sectional view of an embodiment of the present invention, wherein the numeral 8 denotes a polyester mesh (resin insulating layer), and E denotes the electrode.

Figure 3:
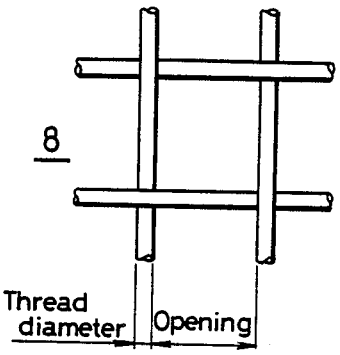
FIG. 3 is a plan view showing the form of the polyester mesh of the FIG. 1.
Figure 4:
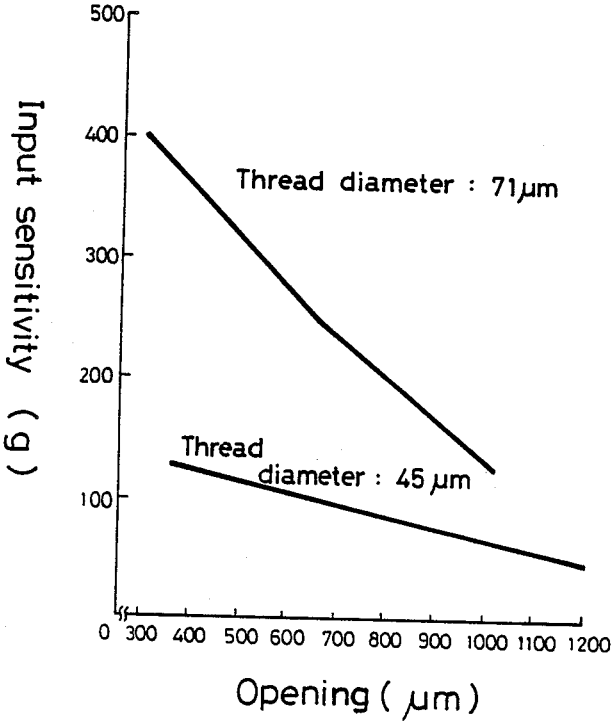
FIG. 4 is a graph of characteristic plottings indicating the relationship between the openings of the polyester mesh and the degree of input sensitivity.

The polyester mesh 8 formed as insulating layer is structured with crossing threads and open spaces formed inbetween, as shown in FIG. 3, providing elasticity against pressure applied repetitively. FIG. 4 is a graph of characteristic plottings indicating the relationship between the openings of the polyester mesh (in $\mu$m) and the degree of input sensitivity (g). The input sensitivity may be increased by adopting smaller thread diameter and wider opening, as illustrated in the graph. Since polyester used as raw material of the thread is of nature capable of providing a thread of comparatively smaller diameter, a tablet for coordinate input which uses polyester mesh 8 as insulating layer may have a stronger power of resolution. The tablet for coordinate input of the embodiment will, when pressure is applied to the electric conductive sheet 5, have the pressured portion of said electric conductive sheet 5 squeezed into the space between the threads of the polyester mesh 8 to contact the electrode E. Once the pressure applied on the electric conductive sheet 5 is released, said sheet 5 will return to its original position due to its elasticity.

Figure 6A:
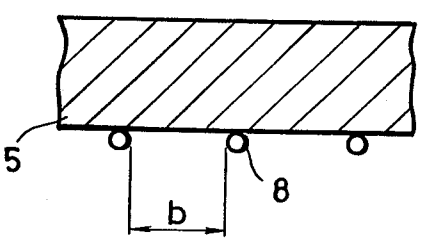
FIGS. 6(*a*) and (*b*) are the cross sections of pressure-sensing electric conductor of present invention at the time when pressure is applied.
Figure 6B:
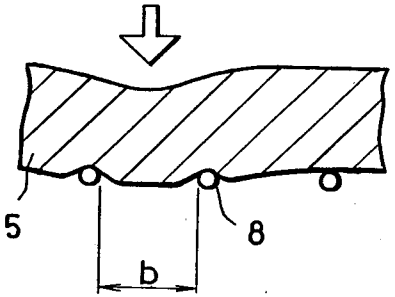
Figure 5A:
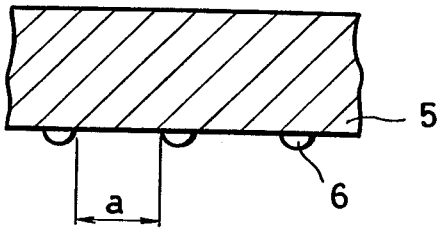
FIGS. 5(*a*) and (*b*) are the cross sections of pressure-sensing electric conductor of prior art at the time when pressure is applied.
Figure 5B:
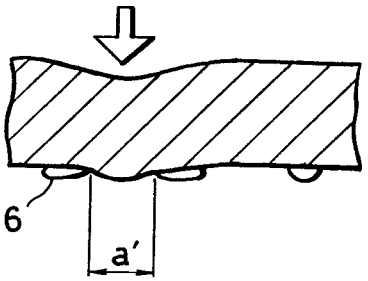

The pressure-sensing electric conductor of prior art using the insulating ink as the insulating layer, and a pressure-sensing electric conductor of this invention using resin material for the same purpose are compared of their respective state when pressure is applied: The conductor of prior art will have distortion in the insulating ink 6 from the exerted pressure and thus shrinking the distance "a" between said solidified ink and adjoining solidified ink to a "a'" ($a > a'$) to result in reduced power of resolution, while the embodiment of this invention will on the contrary, as shown in FIG. 6, have the opening length "b" of the polyester mesh 8 unchanged even when pressure is applied, and will not result in the decreased power of resolution.

While the embodiment of this invention quotes a case wherein the shape of the cross section is circular, it may be angular. A thread having a square cross section is capable of making the pitch narrower. Should a nylon mesh be used instead of a polyester mesh 8, a similar functional result may be obtained.

Figure 7:
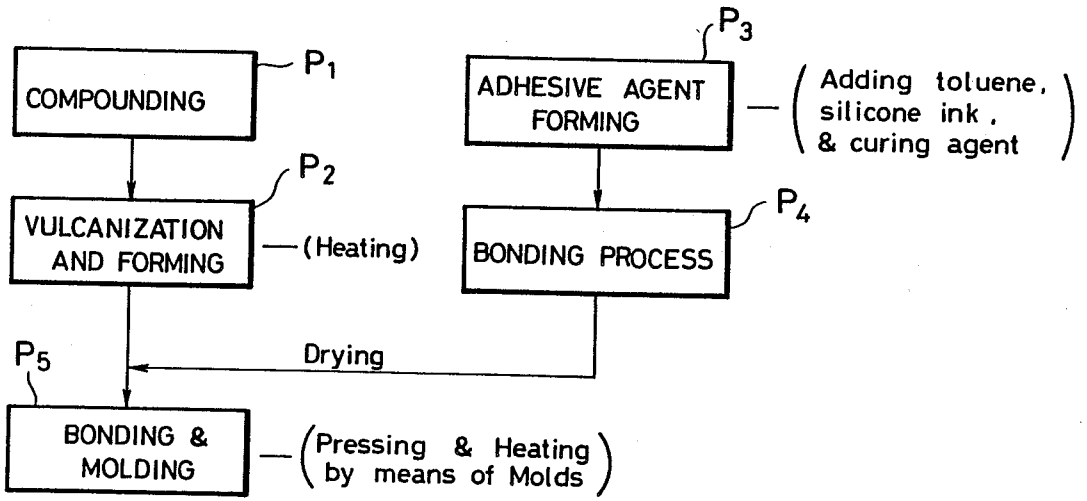
FIG. 7 is a schematic illustration of the manufacturing process whereby the pressure-sensing electric conductor of this invention is produced.

FIG. 7 is a schematic illustration of the manufacturing process whereby the pressure-sensing electric conductor of this invention is produced.

This pressure-sensing electric conductor is produced by laminating a resin insulating layer having a number of holes on the previously mentioned sheet electric conductive substance.

At the process P1, two portions of the LTV (low temperature vulcanization) type electric conductive silicone rubber (a product of Toray Silicone Company Ltd. which is called DY-118A/B by trade name) respectively containing the medium or accelerator agent are mixed, heated and vulcanized at the next process P2 into a sheet form.

At the process P3, on the other hand, the adhesive agent for coating the resin insulating sheet is prepared. Said adhesive agent is a compound of silicon adhesive agent, toluene, and silicone ink mixed together. In this particular embodiment, 7 grams of the silicone adhesive (a product of Toray Silicone Company Ltd. which is called SE1700 by trade name); 100 grams of toluene; 0.7 gram of curing agent; and 0.1 gram of silicone ink ( a product of Toray Silicone Company Ltd. which is called PRK-3 by trade name) are compounded.

Figure 8:
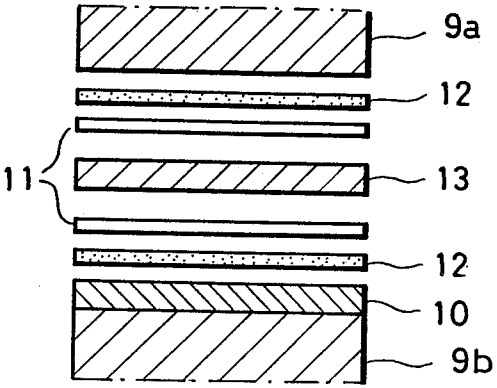
FIG. 8 is a cross section of the pressure-sensing electric conductor of FIG. 7 for illustrating the steps of bonding process.
Figure 9:
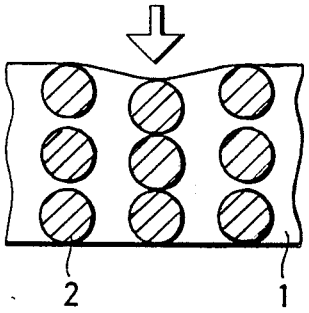
FIG. 9 PRIOR ART
FIG. 9 is the cross section of a pressure-sensing electric conductor of prior art.
Figure 10:
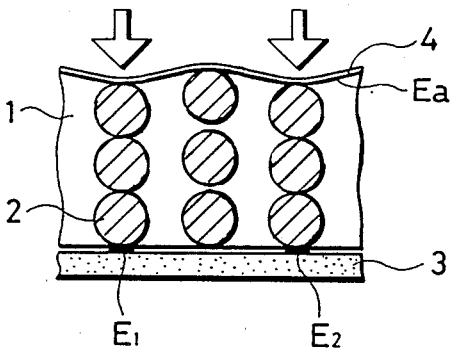
FIG. 10 PRIOR ART
FIG. 10 is the cross section of an embodiment of the pressure-sensing electric conductor of FIG. 9 being applied to a tablet or switch.
Figure 11:
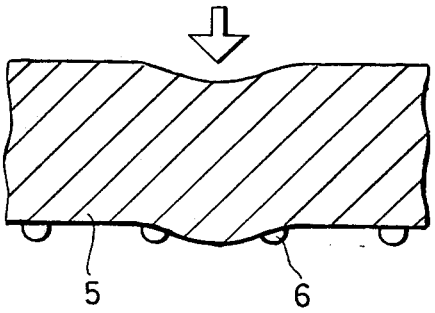
FIG. 11 PRIOR ART
FIG. 11 is the cross section of another type of pressure-sensing electric conductor.
Figure 12:
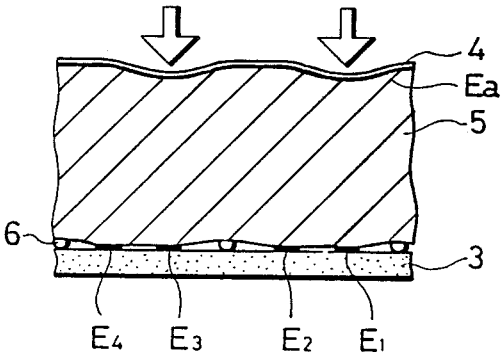
FIG. 12 PRIOR ART
FIG. 12 is the cross section of an embodiment of the pressure-sensing electric conductor of FIG. 11 being applied to a tablet or switch.

At the process P4, said silicone adhesive agent with toluene admixed is coated on the flexible sheet of resin insulating substance having a number of poles, ensured that the coat is securely adhered, and dried. At the process P5, said resin insulating substance and electric conductive substance are placed together and pressured from both sides for bonding by means of a metal mold as shown in FIG. 8. Specifically, the processes that take place in between the upper mold 9*a* and lower mold 9*b* are as follows:

(1) An insulating silicone sheet 10 of about 5 mm in thickness (a product of Shinetsu Chemical Industry Company Ltd. which is called KE951u by trade name) is placed on the lower mold 9*b*.

(2) Polyester film sheets 12 of about 125 μ in thickness (a product of Toray Company Ltd. which is called Lumilar by trade name) are interposed between the resin insulating substance sheets 11 and the upper mold 9*a*, and lower mold 9*b*, respectively.

(3) The electric conductive sheet 13 is positioned in between said resin insulating substance sheets.

(4) The molds are closed to pressurize all above mentioned layers together for bonding into the pressure-sensing electric conductor previously mentioned.

A sufficient adhesive strength may be obtained through the use of said silicone adhesive agent compounded with toluene and silicone ink. Should an ordinary adhesive agent be used, the linear strength of only about 100 g/20 mm may be obtained along the resin insulating substance 11, while the silicone adhesive agent of this embodiment has proved to possess the adhesive strength of 150~200 g/20 mm along the same direction. Since the polyester films 12 and insulating silicone sheet 10 interpose between the upper and lower molds and the resin insulating sheet 11 and electric conductive sheet 13, respectively, the pressure exerted by the molds will not result in said insulating sheet 11 biting into the electric conductive sheet 13 excessively, and thus an insulating layer of uniform thickness may be obtained. The use of the resin insulating sheet 11 eliminates the deterioration in the insulating material over elapsed time, and thus improves the sensitivity characteristics, durability, and other abilities.

The compounding ratio of the adhesive agent is not limited to that mentioned above, and the range of mixture proportions listed in the Table 1 below may provide satisfactory adhesive strength:

TABLE 1

| | |
|---|---|
| Toluene | 100 grams |
| Silicone adhesive agent | 3 ~ 30 grams |
| Curing agent | 0.3 ~ 3 grams |
| Silicone ink | 0.05 ~ 1 gram |

What is claimed is:

1. A pressure-sensing electrical conductor comprising:

an elastic electrically conductive layer, having a flexible resin insulating layer, said layer having a form of a net with a plurality of holes, said insulating layer being overlaid on said elastic conductive layer.

2. A pressure-sensing electric conductor as claimed in claim 1 wherein cross sectional form of the resin insulating layer is formed in a square.

3. A pressure-sensing electric conductor as claimed in claim 1 or claim 2 where the resin insulating layer is formed in latticework made of the resin substance.

4. A pressure-sensing electric conductor as claimed in claim 1 where the resin layer is made of polyester mesh.

5. A pressure-sensing electric conductor as claimed in claim 3, wherein the resin insulating layer is made of polyester mesh, and wherein said elastic electrically conductive layer is made of a silicone rubber.

6. The pressure-sensing electrical conductor according to claim 1, wherein said elastic electrically conductive layer is made of a silicone rubber.

7. The pressure-sensing electrical conductor according to claim 6, wherein said net is formed by threads having a circular cross-section.

8. The pressure-sensing electrical conductor according to claim 6, wherein said net is formed by threads having an angular cross-section.

9. The pressure-sensing electrical conductor according claim 1, wherein said insulating layer consists of two sheets which are overlaid on both sides of said elastic electrically conductive layer.

10. A method of producing pressure-sensing electric conductor comprising:

providing a flexible resin insulating substance in sheet form having a number of holes;

providing an adhesive agent;

coating said flexible resin sheet with said adhesive agent;

providing an elastic electrically conductive substance in a sheet form; and bonding said coated flexible resin sheet to said elastic electrically conductive substance.

11. A method of producing pressure-sensing electric conductor as claimed in claim 10, wherein said elastic electrically conductive substance is a vulcanized silicone rubber, and said adhesive agent is a mixture of a silicone adhesive agent, toluene and silicone ink.

12. A method of producing pressure-sensing electric conductor as claimed in claim 11, wherein said resin insulating substance is in a form of two sheets which are bonded to both sides of said vulcanized silicone rubber electrically conductive sheet.

13. A method of producing pressure-sensing electric conductor as claimed in claim 12, wherein said bonding is utilized by pressing said resin insulating substance sheets and said electrically conductive sheet between molds.

14. The method of producing pressure-sensing electric conductor as claimed in claim 13, wherein polyester films are interposed between said molds and said resin insulating substance sheets before a pressure is applied to said molds.

15. The method of producing pressure-sensing electric conductor as claimed in claim 14, wherein silicone sheets are interposed between said molds and said polyester films before a pressure is applied to said molds.

16. The method according to claim 10, wherein said flexible resin insulating substance is provided in a form of two sheets, and wherein the step of bonding consists of bonding of said two sheets to both sides of said elastic electrically conductive sheet.

* * * * *